US006230667B1

(12) United States Patent
Stauffer et al.

(10) Patent No.: US 6,230,667 B1
(45) **Date of Patent: *May 15, 2001**

(54) REDUCED LENGTH ENGINE GENERATOR ASSEMBLY

(75) Inventors: E. Tony Stauffer, Ephrata; Travis J. Stauffer, Reinholds, both of PA (US)

(73) Assignee: Stauffer Diesel, Inc., Ephrata, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/264,652

(22) Filed: Mar. 8, 1999

(51) Int. Cl.[7] ..... F02B 63/04

(52) U.S. Cl. ..... 123/2; 123/198 E; 123/41.01; 290/1 A

(58) Field of Search ..... 123/2, 41.49, 41.55, 123/41.56, 41.63, 41.65, 198 E; 290/1 A

(56) References Cited

U.S. PATENT DOCUMENTS

| | | | | |
|---|---|---|---|---|
| 5,014,660 | * | 5/1991 | Westerbeke, Jr. | 123/198 E |
| 5,125,378 | * | 6/1992 | Westerbeke, Jr. | 123/198 E |
| 5,908,011 | * | 6/1999 | Stauffer et al. | 123/2 |

* cited by examiner

*Primary Examiner*—Tony M. Argenbright
*Assistant Examiner*—Hai Huynh
(74) *Attorney, Agent, or Firm*—Martin Fruitman

(57) ABSTRACT

The apparatus is an enclosed engine generator assembly with air intake and air discharge openings into the enclosure in which the engine is installed and the radiator for engine cooling moved from the conventional vertical position in front of the engine to a horizontal orientation above the generator. The arrangement permits an assembly with a shorter overall length, but no significant increase in the height, and thereby facilitates installation aboard vehicles.

7 Claims, 4 Drawing Sheets

REDUCED LENGTH ENGINE GENERATOR ASSEMBLY

BACKGROUND OF THE INVENTION

This invention deals generally with engine generator sets and more specifically with the layout of the various engine generator components to reduce the size of the enclosure within which an engine generator may be operated.

Engine generator sets are much more common in our society than one would first suspect. Recreational vehicles frequently have them aboard in order to generate the power to run appliances and entertainment devices without running the much larger vehicle engine. Furthermore, virtually all emergency vehicles, other than police cars, also have independent engine generators for lights and other necessary equipment.

Because all equipment aboard such vehicles is actually competing for space, there is continuing effort to reduce the size of on-board engine generators, but such equipment has unique requirements. First, because the engine of the combination produces significant audible noise, they are usually installed in a sound insulated enclosure which limits access to the equipment inside. However, since the engine requires combustion air and generates exhaust gases and heat, there must be openings into the enclosure for cool air inlet and hot air and exhaust outputs.

Furthermore, particularly with fire department pumper trucks, such engine generator sets are frequently installed on the top of vehicles where the engine generator must be covered for protection from the precipitation and where bottom access to the engine and generator is restricted. This leaves only the sides and ends of the enclosure for access for cooling. Standard engine generator sets therefore continue to use axially air flow through a front mounted radiator but this configuration adds considerably to the length of the enclosure and requires substantial clearance around the enclosure to maintain free air flow.

There is substantial benefit to be derived from an engine generator installation with a reduced length and cooling access limited to the ends and sides, provided there is no substantial increase in height or width of the enclosure.

SUMMARY OF THE INVENTION

The present invention furnishes a significant reduction in the length of an engine generator set by relocating the radiator of the internal combustion engine. The radiator is moved from the conventional location in front of the engine driven fan to an otherwise unused space above the generator. This relocation reduces the overall length of the engine generator assembly by five to twelve inches, but adds nothing to either the height or the width of the assembly.

The engine cooling radiator is mounted horizontally above the generator, where, because the generator has less height than the engine, there is substantial space between the top of the generator and the top of the sound reducing enclosure. In fact, the radiator is separated from the top of the enclosure by sufficient space to accommodate ducts which redirect the vertical flow of air leaving the radiator into a horizontal flow pattern so that it exits the enclosure through the sides of the enclosure. This permits the top of the enclosure to remain a solid sheet and thereby protect the engine generator assembly from exposure to rain and snow. When the original engine fan is used the resulting air flow path within the enclosure not only cools both the engine and the generator, but also furnishes combustion air for the engine.

An alternate embodiment of the invention uses an independently driven cooling fan, such as one powered by an electrical or hydraulic motor, in place of the conventional engine driven fan. This independent fan is placed in an opening of a smaller enclosure which contains only the generator, but the enclosure has its air discharge above the horizontal radiator as in the preferred embodiment. For such an embodiment, the air flow path into the generator enclosure can be through air intakes regardless of their location, because the independent fan draws the air into the generator enclosure and supplies high quality ambient temperature air for the generator and out past the radiator. However, for this embodiment the preferred location for the air intake would be in an accessible side wall of the generator enclosure.

Since the height and depth of the generator is less than the height and depth of the engine and it accessories, the independent fan can be located beside the generator with no increase in the height or depth of the assembly. Thus, since both the radiator and the engine driven fan are removed from in front of the engine, the overall length of an engine generator set using the alternate embodiment of the invention is several inches less than the reduced overall length afforded by the preferred embodiment which still includes the fan in front of the internal combustion engine.

The present invention thereby reduces the length, and, of course, the volume of the compartment required for an engine generator set installed on a vehicle, and the alternate embodiment furnishes the very shortest possible length.

DETAILED DESCRIPTION OF THE INVENTION

Figure 1:
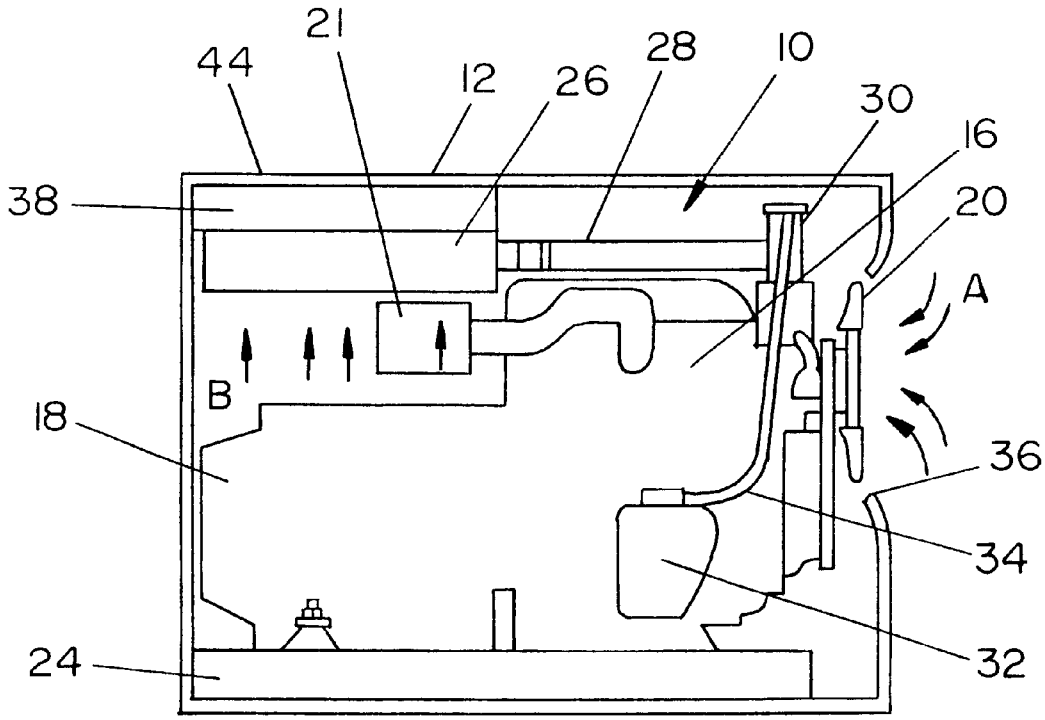
FIG. 1 is a side view showing the layout of the major components of an engine generator set of the preferred embodiment of the invention.
Figure 2:
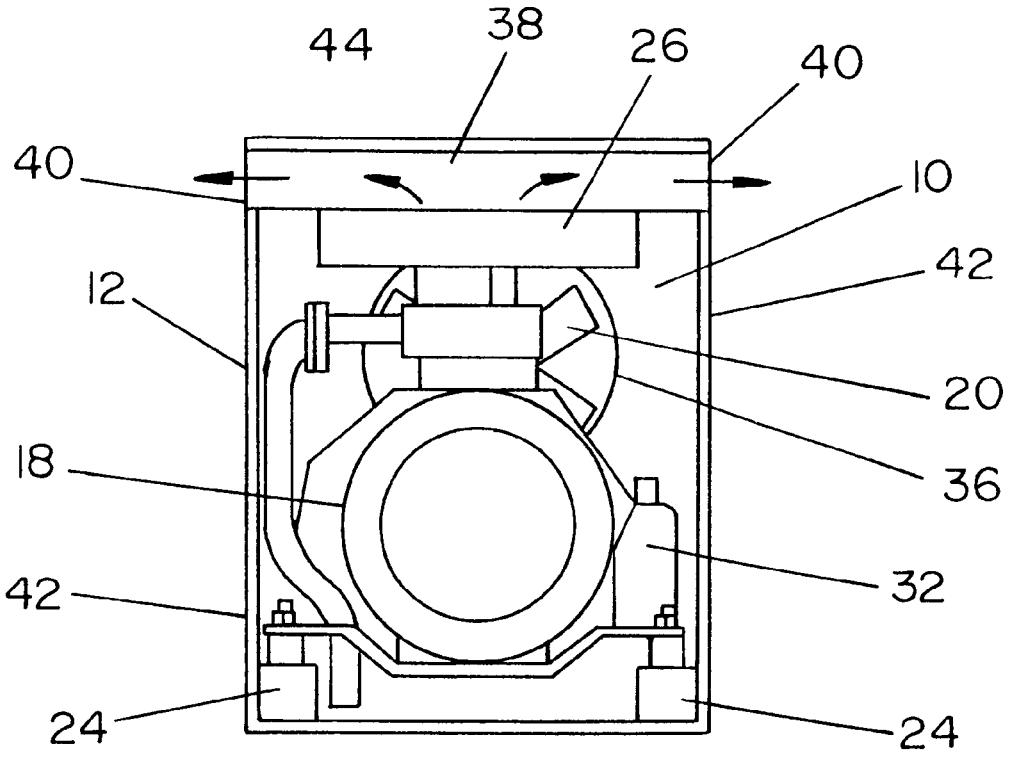
FIG. 2 is a view of the preferred embodiment of the invention from the generator end which shows the discharge air stream.

FIG. 1 is a side view showing the layout of the major components of engine generator assembly 10 of the preferred embodiment of the invention, and FIG. 2 is a view of the preferred embodiment of the invention from the generator end which shows the discharge air stream. Engine generator assembly 10 is located within enclosure 12, which is itself typically located atop a vehicle (not shown). For ease of viewing the invention, enclosure 12 is shown without its vertical near wall. Such a vertical panel is typically a hinged door or removable service access panel.

Engine generator assembly 10 includes liquid cooled, internal combustion engine 16 and electrical generator 18 which are conventionally mechanically interconnected so that engine 16 drives generator 18 which produces electrical power. Engine 16 and generator 18 both have the accessories which are conventionally associated with such devices, such as engine fan 20 and engine air intake filter 21, but most such accessories are not shown because they are not pertinent to the present invention.

Engine 16 and generator 18 are mounted across the top of support beams 24. Support beams 24 are conventional "I" or channel beams. This is a conventional support system in the prior art because it furnishes satisfactory strength and rigidity, and provides a space below engine 16 and generator 18 to aid in moving assembly 10.

Radiator 26 is interconnected with the liquid cooling system of engine 16 through pipes 28, the second of which is behind the one shown in FIG. 1, and the present invention locates radiator 26 in a unique position above generator 18 and in a horizontal orientation. This location furnishes the benefit of reducing the length of engine generator assembly 10 by several inches, at least the distance equal to the thickness of radiator 26 and the clearance normally required between radiator 26 and engine fan 20.

In the prior art, radiator 26 is, of course, adjacent to fan 20, on the opposite side of the fan from engine 16. However, the new location for radiator 26 provided in the present invention not only reduces the overall length of engine generator assembly 10, but adds no height or depth to the assembly. The location above generator 18 has previously been available but unused space.

The relocation of radiator 26 requires some other minor modifications in the structure of engine generator assembly 10. For instance, coolant refill cap 30 is no longer attached directly to radiator 26 as in the prior art. Instead, refill cap 30 is located at the highest part of the coolant system atop engine 16, and coolant pipe 28 which is connected to radiator 26 is attached to the usual short stub of pipe to which refill cap 30 is connected. Coolant reservoir 32 is then connected to the coolant system in conventional fashion by hose 34 attached below refill cap 30.

Because radiator 26 is not located adjacent to fan 20, some changes are also required to properly direct the cooling air stream through radiator 26. This is largely accomplished by locating engine generator assembly 10 within enclosure 12 which has only air inlet opening 36 located adjacent to fan 20 and air discharge duct 38 adjacent to radiator 26. Therefore, cooling air, indicated by arrows A flows into enclosure 12 through air inlet opening 36. It is pulled in by fan 20, and then moves through enclosure 12, past engine 16 and generator 18, and out of enclosure 12 by going through radiator 26 and out air discharge duct 38. Air moving through radiator 26 is indicated by arrows B. The cooling air passing through enclosure 12 is also available to cool generator 18 and to supply combustion air for engine 16 through engine air intake filter 21.

When engine generator assembly 10 is used in a typical application aboard a vehicle (not shown), enclosure 12 requires at least 5 inches of clearance in front of air inlet opening 36 to permit free flow of cooling air A entering enclosure 12.

As shown more clearly in FIG. 2, which is a view of engine generator set 10 from the generator end with the near vertical wall of enclosure 12 removed, air discharge duct 38 has its openings 40 in the long vertical walls 42 of enclosure 12. The view of air discharge duct 38 shown in FIG. 1 is therefore a view directly into an opening 40 of air discharge duct 38. Since air discharge openings 40 are in the vertical walls 42, top 44 of enclosure 12 thereby protects the interior of enclosure 12 from precipitation.

Figure 3:
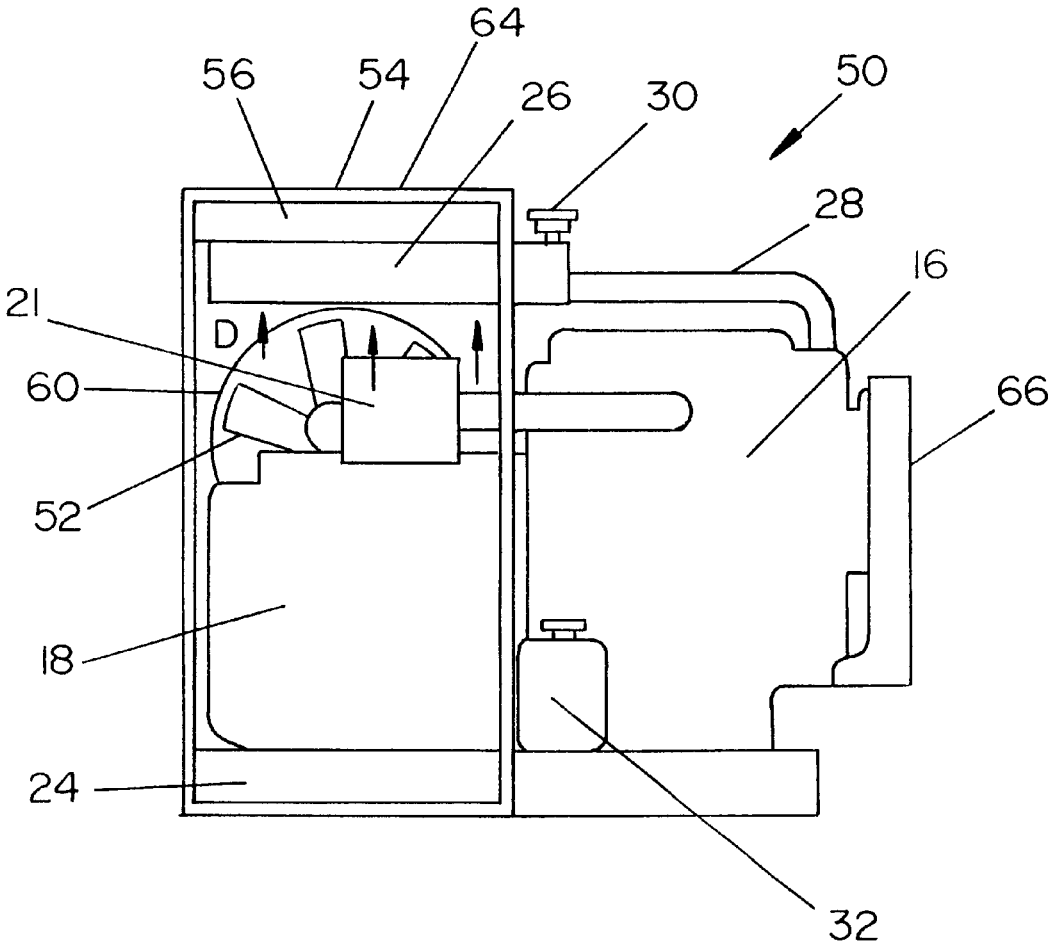
FIG. 3 is a side view showing the layout of the major components of an engine generator set of an alternate embodiment of the invention with an independent fan.
Figure 4:
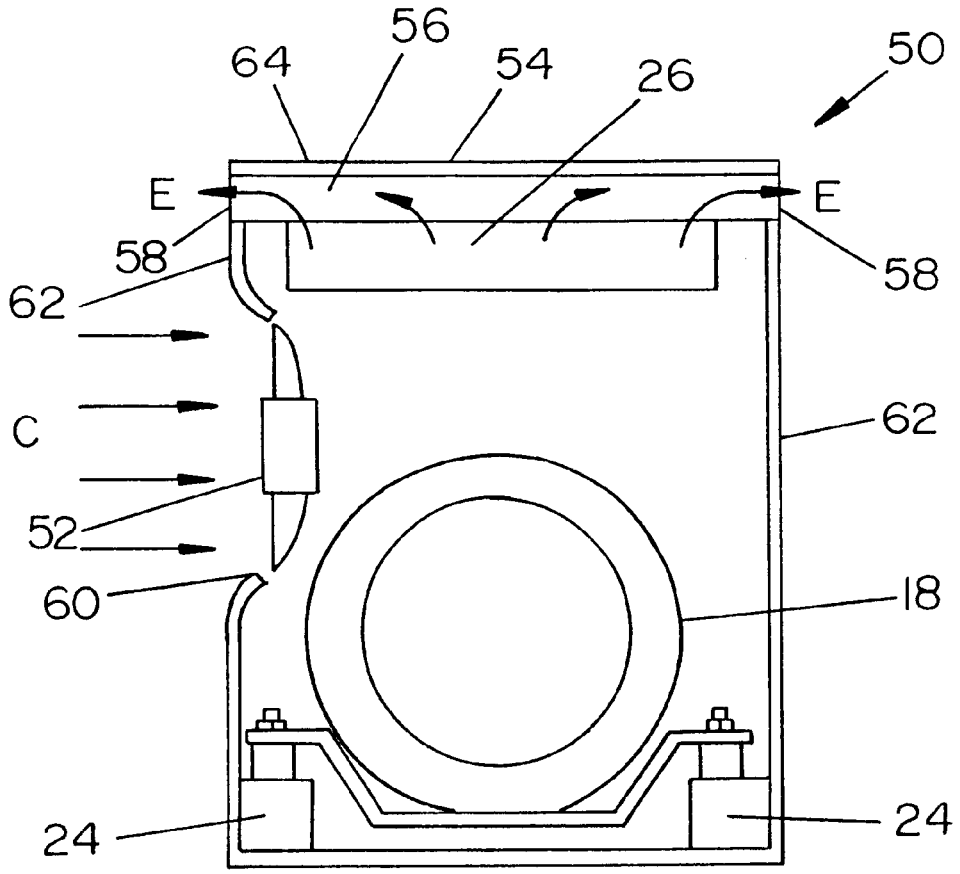
FIG. 4 is a generator end view of the alternate embodiment of the invention which shows the discharge air stream.

FIG. 3 is a side view and FIG. 4 is a view from the generator end showing the layout of the major components of engine generator set 50 of an alternate embodiment of the invention. Many of the components of engine generator assembly 50 are identical to those of engine generator assembly 10 of FIG. 1 and are therefore labeled with the same identifying numbers. Both FIG. 3 and FIG. 4 are shown with the nearer vertical panel of enclosure 54 removed to view the components within the enclosure.

The essential difference between engine generator assembly 50 of FIGS. 3 and 4 and engine generator assembly 10 of FIGS. 1 and 2, is that engine driven fan 20 is not included in the embodiment of FIG. 3. Instead, independently driven fan 52, which can be powered electrically or hydraulically, is installed within enclosure 54. Enclosure 54 is also smaller than enclosure 12 of FIG. 1 because it encloses only generator 18. Enclosure 54 has flexible sealing joints (not shown) surrounding the junction of engine 16 and generator 18, and at the entry points of auxiliary devices to minimize air loss at such entry points. Enclosure 54 includes air inlet opening 60 through which high quality ambient temperature cooling air, indicated by arrows C, is drawn into enclosure 54 by fan 52, and fan 52 also pushes air (arrows D) from within enclosure 54 through radiator 26, into exhaust duct 56, and out air discharge openings 58. The discharged air is indicated by arrows labeled E, and, as can be seen in FIG. 4, air discharge openings 58 are located on vertical walls 62 of enclosure 54. Top 64 therefore protects the interior of enclosure 54 from snow and rain.

As can be seen in FIG. 3, the removal of the engine driven fan further shortens engine generator assembly 50 by several inches, most of the depth of the engine driven fan. However, even after removing the fan some rotating parts remain at the front of the engine, and it is desirable to cover those parts with guard 66.

It should also be appreciated that it is practical to operate both the embodiments of FIG. 2 and FIG. 4 with only one discharge opening for their exhaust ducts 38 and 56.

The invention therefore yields a reduction in length without any increase in other dimensions, provides a compact unit usable aboard vehicles with either water or oil cooled engines, and permits simple installation with only two openings for air intake and discharge. Of course, another openings can be included for the engine exhaust and access for controls and electrical power.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, independent fan 52 can be located on other walls of enclosure 54. Furthermore, the air flow could be reversed so that air moves into the enclosure through openings 40 and 58 of the disclosed embodiments and out openings 36 and 60 adjacent to the fans.

What is claimed as new and for which Letters Patent of the United States are desired to be secured is:

1. In an engine generator assembly with a liquid cooled internal combustion engine connected to and driving an electrical generator and including a radiator interconnected to the engine liquid cooling system, the improvement comprising:

- a radiator interconnected to the engine liquid cooling system oriented horizontally and located above the generator;
- a walled enclosure enclosing generator;
- a first opening in an enclosure wall, the first opening located accessible to the radiator and above the radiator so that air moving through the first opening also moves through the radiator;
- a second opening in an enclosure wall with access to air outside the enclosure; and a fan located within the enclosure, moving air into the enclosure through one air opening and moving air from within the enclosure out the other air opening.

2. The engine generator assembly of claim 1 wherein the engine is also located within the enclosure and the fan is mechanically connected to the engine and driven by the engine.

3. The engine generator assembly of claim 1 wherein the engine is also located within the enclosure, the fan is mechanically connected to the engine and driven by the engine, and an air inlet opening is located adjacent to the fan.

4. The engine generator assembly of claim 1 wherein the fan is driven by an independently powered motor.

5. The engine generator assembly of claim 1 wherein the first opening is an opening located in a vertical wall of the enclosure and an air flow duct is located between the radiator and the first opening.

6. The engine generator assembly of claim 1 wherein the second opening is located in a vertical wall of the enclosure and the fan is located adjacent to the second opening and driven by an independently powered motor.

7. The engine generator assembly of claim 1 wherein the radiator is protected by the top of the enclosure located between the radiator and the outside environment.

* * * * *